US008173340B2

(12) United States Patent
Kanungo et al.

(10) Patent No.: US 8,173,340 B2
(45) Date of Patent: May 8, 2012

(54) DIGITAL ELECTROSTATIC LATENT IMAGE GENERATING MEMBER

(75) Inventors: Mandakini Kanungo, Webster, NY (US); Kock-Yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 422 days.

(21) Appl. No.: 12/539,557

(22) Filed: Aug. 11, 2009

(65) Prior Publication Data

US 2011/0039196 A1 Feb. 17, 2011

(51) Int. Cl.
*G03G 15/00* (2006.01)

(52) U.S. Cl. ..... 430/58.05

(58) Field of Classification Search ..... None
See application file for complete search history.

(56) References Cited

U.S. PATENT DOCUMENTS

| | | | | |
|---|---|---|---|---|
| 3,121,006 | A | 2/1964 | Middleton et al. | |
| 4,286,033 | A | 8/1981 | Neyhart et al. | |
| 4,291,110 | A | 9/1981 | Lee | |
| 4,338,387 | A | 7/1982 | Hewitt | |
| 4,464,450 | A | 8/1984 | Teuscher | |
| 4,921,773 | A | 5/1990 | Melnyk et al. | |
| 5,215,839 | A | 6/1993 | Yu | |
| 5,660,961 | A | 8/1997 | Yu | |
| 5,958,638 | A | 9/1999 | Katayama et al. | |
| 6,100,909 | A * | 8/2000 | Haas et al. | 347/141 |
| 2006/0103694 | A1 * | 5/2006 | Nguyen | 347/47 |

* cited by examiner

*Primary Examiner* — Stephen Meier
*Assistant Examiner* — Alexander C Witkowski
(74) *Attorney, Agent, or Firm* — Pillsbury Winthrop Shaw Pittman LLP

(57) ABSTRACT

Embodiments pertain to a novel imaging member, namely, an electrostatic latent image generating member that can generate an electrostatic latent image digitally without using a raster output scanner (ROS), photoreceptor and charger. The imaging member facilitates the charge injection process between an organic conjugated polymer and N,N'-diphenyl-N,N'bis(3-methylphenyl)-[1,1'-biphenyl]-4,4'diamine charge transport layer.

21 Claims, 4 Drawing Sheets

DIGITAL ELECTROSTATIC LATENT IMAGE GENERATING MEMBER

CROSS REFERENCE TO RELATED APPLICATIONS

Reference is made to copending, commonly assigned U.S. patent application Ser. No. 12/539,397 filed on Aug. 11, 2009, entitled, "Digital Electrostatic Latent Image Generating Member," the entire disclosure of which is incorporated herein by reference in its entirety.

BACKGROUND

The presently disclosed embodiments pertain to a novel imaging member, namely, an electrostatic latent image generating member that can generate an electrostatic latent image digitally without using a raster output scanner (ROS) and photoreceptor, and perhaps also without charger.

In electrophotographic or electrophotographic printing, the charge retentive surface, typically known as a photoreceptor, is electrostatically charged, and then. exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a ROS, where a charged surface may be imagewise discharged in a variety of ways.

Thus, it can be seen that current xerographic printing involves multiple steps, such as, charging the photoreceptor, developing the latent images, transferring and fusing the developed images, erasing and cleaning the photoreceptor. These multiple steps require many electromechanical components, which leads to more opportunities for system breakdowns or failures. Future trends in the industry are focusing on using machines that are smaller, faster, smarter, less costly and environmentally friendly. Thus, there is a need to redesign engine architecture to achieve machines that use less electromechanical components, such as for example, a printing apparatus with a new electrostatic latent image generating member which can generate electrostatic latent image digitally without using a ROS, a photoreceptor and may be without a charger.

Digitalization of the xerographic process has been proposed as a possible solution. However, many of the proposed designs still involved many components. For example, in U.S. Pat. No. 6,100,909, hereby incorporated by reference in its entirety, there was described an image-forming apparatus comprising high voltage thin film transistors (TFT) and capacitors. The electrostatic latent images are formed directly on the non-conducting imaging member by switching on the high voltage capacitors via the high voltage TFTs. However, the disadvantage to this design was that the apparatus required the use of high voltage capacitors to drive the backplane.

The present embodiments provide digitalization of the xerographic marking process in a manner that result in a smaller, smarter and more efficient machine.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule" or "electron transport molecules."

SUMMARY

According to aspects illustrated herein, there is provided an electrostatic image generating member, comprising a substrate, a hole injection layer disposed on the substrate, the hole injection layer further comprising an addressable active matrix backplane, and a polymer film disposed on the addressable active matrix backplane, and a charge transport layer disposed on the hole injection layer, wherein the polymer film comprises organic conjugated polymer patterned on the addressable active matrix backplane.

In another embodiment, there is provided an electrostatic image generating member, comprising a substrate, an adhesive layer disposed on the substrate, a hole injection layer disposed on the adhesive layer, the hole injection layer further comprising an addressable active matrix backplane, and a polymer film disposed on the addressable active matrix backplane, a hole blocking layer disposed on the hole injection layer, and a charge transport layer disposed on the hole injection layer, wherein the polymer film comprises poly(3,4-ethylenedioxytbiophene) patterned on the addressable active matrix backplane.

Yet another embodiment, there is provided an image forming apparatus for forming images on a recording medium comprising a) an imaging member having a charge retentive-surface for receiving an electrostatic latent image thereon, wherein the imaging member comprises a substrate, a hole injection layer disposed on the substrate, the hole injection layer further comprising an addressable active matrix backplane, and a polymer film disposed on the addressable active matrix backplane, and a charge transport layer disposed on the hole injection layer, b) a development component for applying a developer material to the charge-retentive surface to develop the electrostatic latent image to form a developed image on the charge-retentive surface, c) a transfer component for transferring the developed image from the charge-retentive surface to a copy substrate, and d) a fusing component for fusing the developed image to the copy substrate.

BRIEF DESCRIPTION OF THE DRAWINGS

For a better understanding, reference may be made to the accompanying figures.

DETAILED DESCRIPTION

Figure 1:
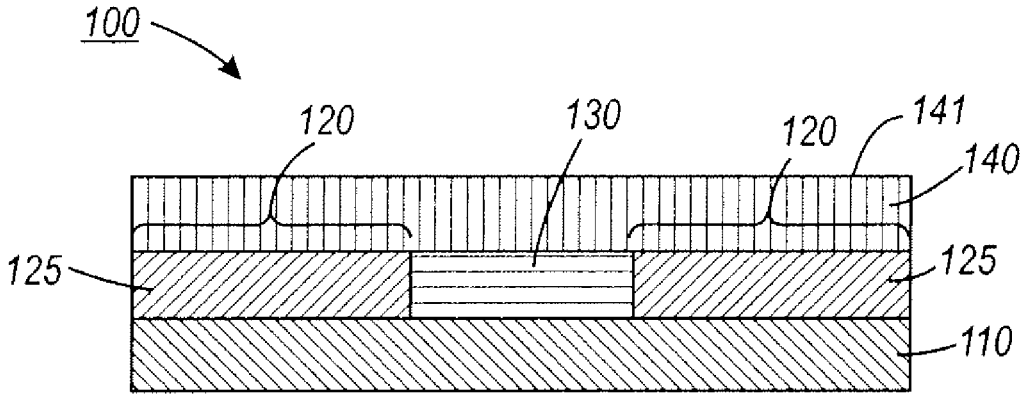
FIG. 1 is a cross-section of an electrostatic latent image generating member according to the present various embodiments.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments generally pertain to a novel imaging member that provides for digitalization of the xerographic marking process in a manner that requires far fewer electromechanical components than conventional image-forming apparatuses. In particular, the present embodiments provide an electrostatic latent image generating member that can generate an electrostatic latent image digitally without using a raster output scanner (ROS), photoreceptor and charger.

In embodiments, the electrostatic latent image generating member comprises an organic conjugated polymer in an injection layer and a charge transport layer. Based on the charge-discharge result, the conjugated polymer injects the hole to the N,N'-diphenyl-N,N'bis(3-methylphenyl)-[1,1'-biphenyl]-4,4'diamine (m-TBD) hole transport layer under the influence of the electric field, leading to discharge of the imaging member. In specific embodiments, the organic conjugated polymer is poly(3,4-ethylenedioxythiophene) (PEDOT) and other conjugated polymers based on 3,4-ethylenedioxythiophene (EDOT) derivatives including, but not limited to, alkyl substituted EDOT, phenyl substituted EDOT, dimethyl substituted polypropylenedioxythiophene, cyanobiphenyl substituted 3,4-ethylenedioxythiopene, teradecyl substituted PEDOT, dibenzyl substituted PEDOT, an ionic group substituted PEDOT, such as, sulfonate substituted PEDOT, a dendron substituted PEDOT, such as, dendronized poly(para-phenylene), and the like, and mixtures thereof. In further embodiment, the organic conjugated polymer is PEDOT:polystyrene sulfonic acid (PSS) complex. The molecular structure of PEDOT:PSS is shown below:

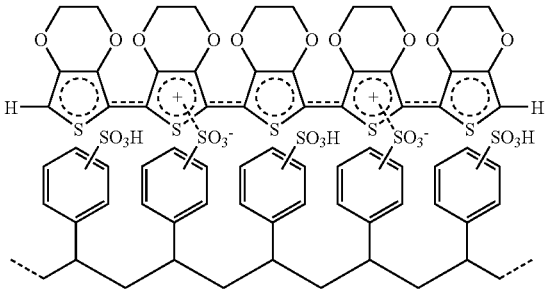

PEDOT:PSS can be obtained through the polymerization of EDOT in the presence of a template polymer, such as polystyrene sulfonic acid. The conductivity of PEDOT:PSS film can be enhanced by adding compounds with two or more polar groups, such as for example, ethylene glycol, into an aqueous solution of PEDOT:PSS. As discussed in Alexander M. Nardes, "On the Conductivity of PEDOT:PSS Thin Films," Thesis 2007, Chapter 2, Eindhoven Univeristy of Technology, which is hereby incorporated by reference, such an additive induces conforrnational changes in the PEDOT chains in the PEDOT:PSS film. The conductivity of PEDOT can be adjusted during the oxidation step. Aqueous dispersions of PEDOT:PSS is commercially available as BAYTRON P from H. C. Starck, Inc. (Boston, Mass.). PEDOT:PSS films coated on Mylar is available in Orgacon films. PEDOT may also be obtained through chemical polymerization by using several methods and oxidants. However, an especially useful polymerization method uses electrochemical oxidation of the electron-rich EDOT-based monomers both from aqueous and nonqueous medium, as disclosed in Li Niu et al., "Electrochemically controlled surface morphology and crystallinity in poly(3,4-ethylenedioxythiophene) films," Synthetic Metals, 2001, Vol. 122, 425-429, and Mark Lefebvre et al., "Chemical Synthesis, Characterization, and Electrochemical Studies of Poly(3,4-ethylenedioxythiophene)/Poly(styrene-4-sulfonate) Composites," Chemistry of Materials, 1999, Vol. 11, 262-268, which are hereby incorporated by reference.

As also discussed in the above references, the electrochemical synthesis of PEDOT requires only a small amount of monomer, had short polymerization times, and can yield both electrode-supported and freestanding films.

In embodiments, the surface resistivity of the organic conjugated polymer films is from about 100 ohm/sq. to about 10,000 ohm/sq. or from 100 ohm/sq. to about 5,000 ohm/sq. or from about 250 ohm/sq. to about 5,000 ohm/sq.

The electrostatic latent image generating member of the present embodiments has only two layers as compared to the multiple layers of conventional drum or belt photoreceptors. The electrostatic latent image generating member can be charged up negatively and, following an injection of the holes from the PEDOT to the charge transport layer, can result in almost total discharge. The charge-discharge process will not occur in the absence of the organic conjugated polymer layer. Replacement of the hole injection layer comprising the organic conjugated polymer with a metalized MYLAR, such as the ZrTi substrate used in belt photoreceptors, also does not enable the charge-discharge process to occur.

Because PEDOT is known to be patternable by a number of nano-manufacturing techniques, PEDOT can be patterned onto an addressable active matrix backplane. For example, a PEDOT film may be easily patterned onto a substrate by inkjet printing, screen printing, transfer printing, and the like. By patterning the PEDOT onto an active matrix backplane, digital electrostatic latent images can be generated by electrically biasing the PEDOT pixel either positive or negative or simply just grounded with the help of the addressable matrix backplane, without using a ROS, photoreceptor and charger. For example, as shown in FIG. 1, according to various embodiments of the present teachings, the electrostatic latent image generating member 100 can include a substrate 110 and an array of pixels 120 disposed over the substrate 110, such that each pixel 125 of the array of pixels 120 is electrically isolated and is individually addressable. The phrase "individually addressable" as used herein means that each pixel of an array of pixels can be identified and manipulated independently of it surrounding pixel, for example, each pixel can be individually bias positively or negatively independently of its surrounding pixel. The array of pixels 120 is electrically isolated by an insulated area 130. In some embodiments, however, instead of addressing the pixels 125 individually, a group of pixels 125 including two or more pixels 125 can be addressed together, for example, a group of pixels 125 can be biased positively or negatively or neutral together independently from the other pixels 125 or other groups of pixels 125. The electrostatic latent image generating member 100 can also include a charge transport layer 140 that includes a surface 141 disposed opposite to the array of pixels 120. The charge transport layer 140 can be configured to transport holes provided by the one or more pixels 125 to the surface 141.

In the present embodiments, each pixel of the array of pixels 120 may include a layer or film of an organic conjugated polymer, such as PEDOT. The film of organic conjugated polymer acts as the hole injection material for the electrostatic generation of images. The advantage of using such materials as hole injection layers is that they can be easily patternable by various nanofabrication techniques. As a result, generation of digital electrostatic latent images can be produced without using a ROS, photoreceptor and perhaps even a charger. The generated electrostatic charges can be developed by dry powder or liquid ink, depending on the development system.

Figure 2:
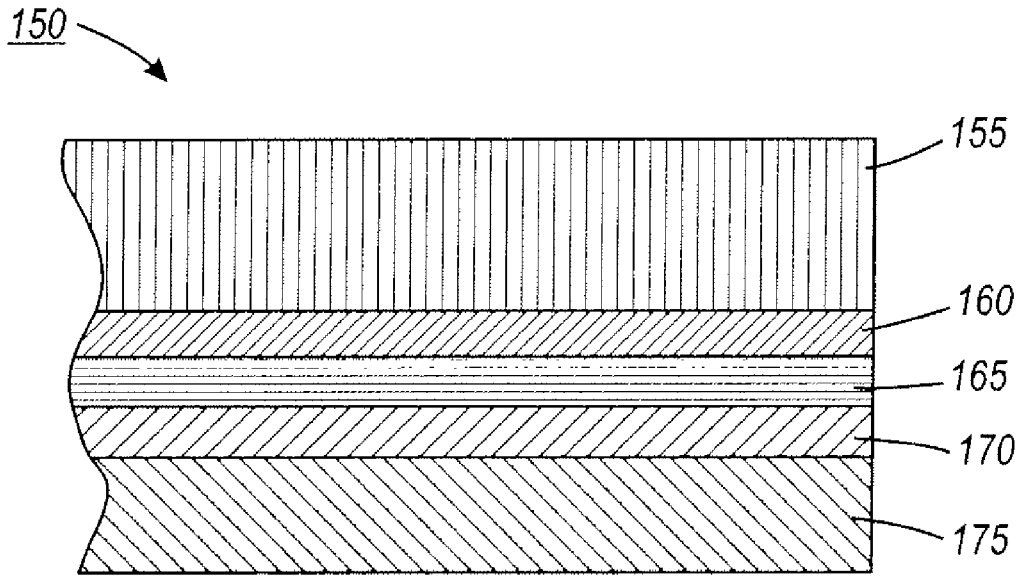
FIG. 2 is an alternative view of a cross-section of an electrostatic latent image generating member according to the present embodiments.

In FIG. 2, the cross-section of the electrostatic latent image generating member 150 according to an alternative embodiment is represented. The electrostatic latent image generating member 150 comprises a hole injection layer 165 and a charge transport layer 155. An optional "charge blocking layer" or "hole blocking layer" 160 and an optional adhesive layer 170 may also be included. The hole injection layer 165 comprises a film comprising an organic conjugated polymer, such as PEDOT, disposed on an addressable active matrix backplane. The hole injection layer 165 is disposed upon a substrate 175. The hole injection layer 165 is formed by applying the film to an addressable active matrix backplane to form an array of pixels on the substrate as described above. In embodiments, the electrostatic latent image generating member may also include a charge transport layer disposed over the hole injection layer (and the array of pixels), wherein the charge transport layer includes a surface disposed opposite to the array of pixels. The charge transport layer can be configured to transport holes provided by the one or more pixels to the surface of the charge transport layer.

In various embodiments, the PEDOT film can be formed by depositing a thin layer of the organic conjugated polymer over one or more supporting layers using conventional deposition techniques such as, for example, dip coating, spray coating, spin coating, web coating, draw down coating, flow coating, and extrusion die coating. Non-limiting examples of supporting layers include polyethylene, oriented polyethylene terephthalate (PET such as MYLAR from DuPont), oriented Polyethylene Naphthalate (PEN available as KALEDEX 2000), polyimide, polycarbonate, and other synthetic polymeric materials. According to further embodiments, the organic conjugated polymeric film can include one or more of a plurality of PEDOT, PEDOT:PSS complex or any conjugated polymers based on 3,4-ethylenedioxythiophene (EDOT) derivatives including, but not limited to, alkyl substituted EDOT, phenyl substituted EDOT, dimethyl substituted polypropylenedioxythiophene, cyanobiphenyl substituted 3,4-ethylenedioxythiopene, teradecyl substituted PEDOT, dibenzyl substituted PEDOT, an ionic group substituted PEDOT, such as, sulfonate substituted PEDOT, a dendron substituted PEDOT, such as, dendronized poly(paraphenylene), and the like, and mixtures thereof.

After deposition of the hole injection layer 165, the hole blocking layer 160 may be applied thereto. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$(gamma-aminopropyl) methyl diethoxysilane, as disclosed in U.S. Pat. Nos. 4,338,387, 4,286,033 and 4,291,110.

The hole blocking layer 160 should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior.

The hole blocking layer 160 should be continuous and have a thickness of less than about 0.5 micrometer because greater thicknesses may lead to undesirably high residual voltage. A hole blocking layer of between about 0.005 micrometer and about 0.3 micrometer is used for optimal electrical performance. A thickness of between about 0.03 micrometer and about 0.06 micrometer is used for hole blocking layers for optimum electrical behavior.

The charge transport layer 155 may include any suitable charge transport component or activating compound useful as an additive dissolved or molecularly dispersed in an electrically inactive polymeric material, such as a polycarbonate binder, to form a solid solution and thereby making this material electrically active. In embodiments, the charge transport molecule is present in the charge transport layer in an amount of from about 10% to about 60%. In further embodiments, the charge transport molecule is selected from the group consisting of N,N'-diphenyl-N,N'-bis(alkylphenyl)-1,1'-biphenyl-4,4'-diamine, wherein alkyl is selected from the group consisting of methyl, ethyl, propyl, butyl, hexyl, and the like, and mixtures thereof, N,N'-diphenyl-N,N'-bis(halophenyl)-1,1'-biphenyl-4,4'-diamine, wherein the halo substituent is a chloro substituent; N,N'-bis(4-butylphenyl)-N,N'-di-p-tolyl-[p-terphenyl]-4,4"-diamine; N,N'-bis(4-butylphenyl)-N,N'-di-m-tolyl-[p-terphenyl]-4,4"-diamine; N,N'-bis(4-butylphenyl)-N,N'-di-o-tolyl-[p-terphenyl]-4,4"-diamine; N,N'-bis(4-butylphenyl)-N,N'-bis-(4-isopropylphenyl)-[p-terphenyl]-4,4"-diamine; N,N'-bis(4-butylphenyl)-N,N'-bis-(2-ethyl-6-methylphenyl)-[p-terphenyl]-4,4"-diamine; N,N'-bis(4-butylphenyl)-N,N'-bis-(2,5-dimethylphenyl)-[p-terphenyl]-4,4'-diamine; N,N'-diphenyl-N,N'-bis(3-chlorophenyl)-[p-terphenyl]-4,4"-diamine, and the like, and mixtures thereof. In further embodiments, the charge transport molecules may also be selected from the group consisting of pyrazolines, diamines, hydrazones, oxadiazoles, stilbenes and mixtures thereof and wherein the electrically inert polymer is selected from the group consisting of polycarbonate resin, polyester, polyarylate, polysulfone, and mixtures thereof.

"Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of holes from the PEDOT injection layer and incapable of allowing the transport of these holes through. This addition converts the electrically inactive polymeric material to a material capable of supporting the injection of holes from the PEDOT injection layer and capable of allowing the transport of these holes through the charge transport layer in order to generate the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

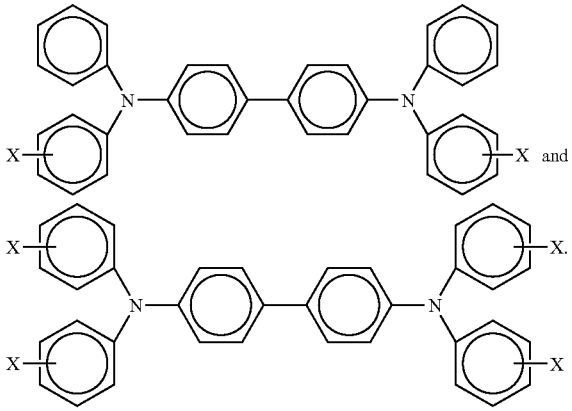

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

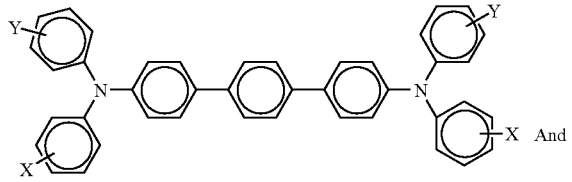

-continued

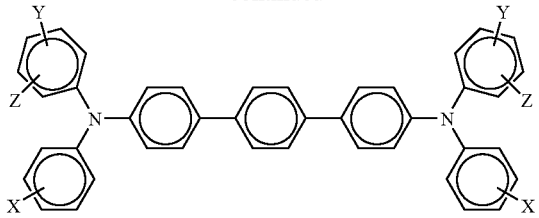

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from I to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer 155 should be an insulator to the extent that the electrostatic charge placed on the hole transport layer is not conducted at a rate sufficient to prevent formation and retention of an electrostatic latent image thereon. The charge transport layer is electrically "active" in that it allows the injection of holes from the organic conjugated polymer injection layer, and allows these holes to be transported through itself to selectively discharge a surface charge on the surface of the active layer.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum electrical and mechanical results. In another embodiment the thickness is from about 14 μm to about 36 μm.

Figure 3A:
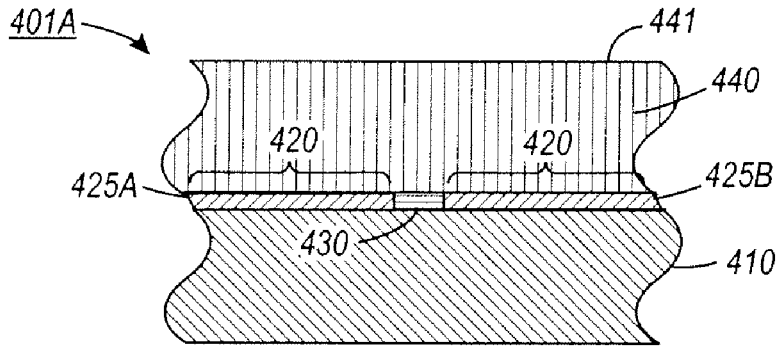
FIGS. 3A-3D schematically illustrate an exemplary method of forming an electrostatic latent image according to the present embodiments.
Figure 3B:
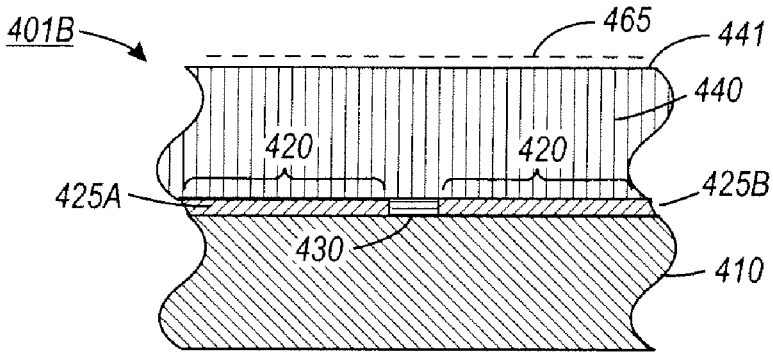
Figure 3C:
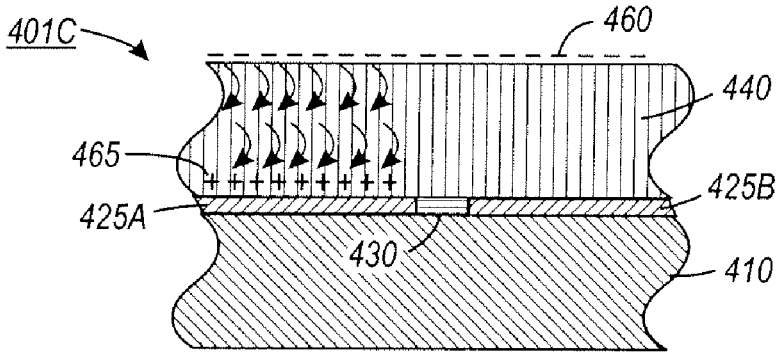
Figure 3D:
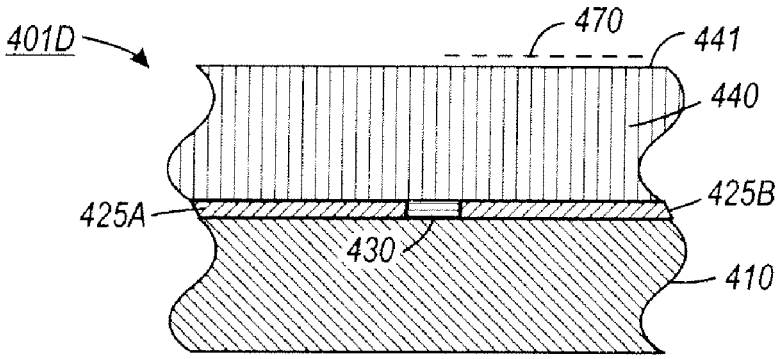

As illustrated in FIGS. 3A-3D, the method of forming an electrostatic latent image 470 with the electrostatic latent image generating member 401 A of the present embodiments can include creating a negative surface charge 460 on a surface 441 of the charge transport layer 440, the surface 441 being disposed on a side opposite the array of pixels 420. The array of pixels 420 is electrically isolated by an insulated area 430 and disposed upon the substrate 410. FIG. 3B illustrates a portion of an electrostatic latent image generating member 401B having a negative surface charge 460 on the surface 441 of the charge transport layer 440. The surface charge 460 can be applied using any suitable method, such as, for example, by applying an appropriate electrical bias. The method can further include forming an electrostatic latent image 470 on the surface 441 of the charge transport layer 440 by individually addressing one or more pixels 425A, 425B to discharge the negative surface charge 460 on the surface 441 of the charge transport layer 440 corresponding to the one or more pixels 425A, 425B. FIG. 3C illustrates a portion of the electrostatic latent image generating member 401C, wherein the pixel 425A is addressed and a bias is applied, whereas no bias is applied to pixel 425B. As a-result of the application of bias to the pixel 425A, the organic conjugated polymeric film disposed in the pixel 425A injects holes 465 at the interface of the pixel 425A and the charge transport layer 440. As shown in FIG. 3C, the charge transport layer 440 transports the holes 465 to the surface 441 to neutralize the surface charge 460 and create a latent image. FIG. 3D illustrates a portion of the electrostatic latent image generating member 401D comprising a latent image 470 formed by individually addressing one or more pixels 425A, 425B to discharge the negative surface charge 460 on the surface 441 of the charge transport layer 440 corresponding to the one or more pixels 425A, 425B.

Figure 4:
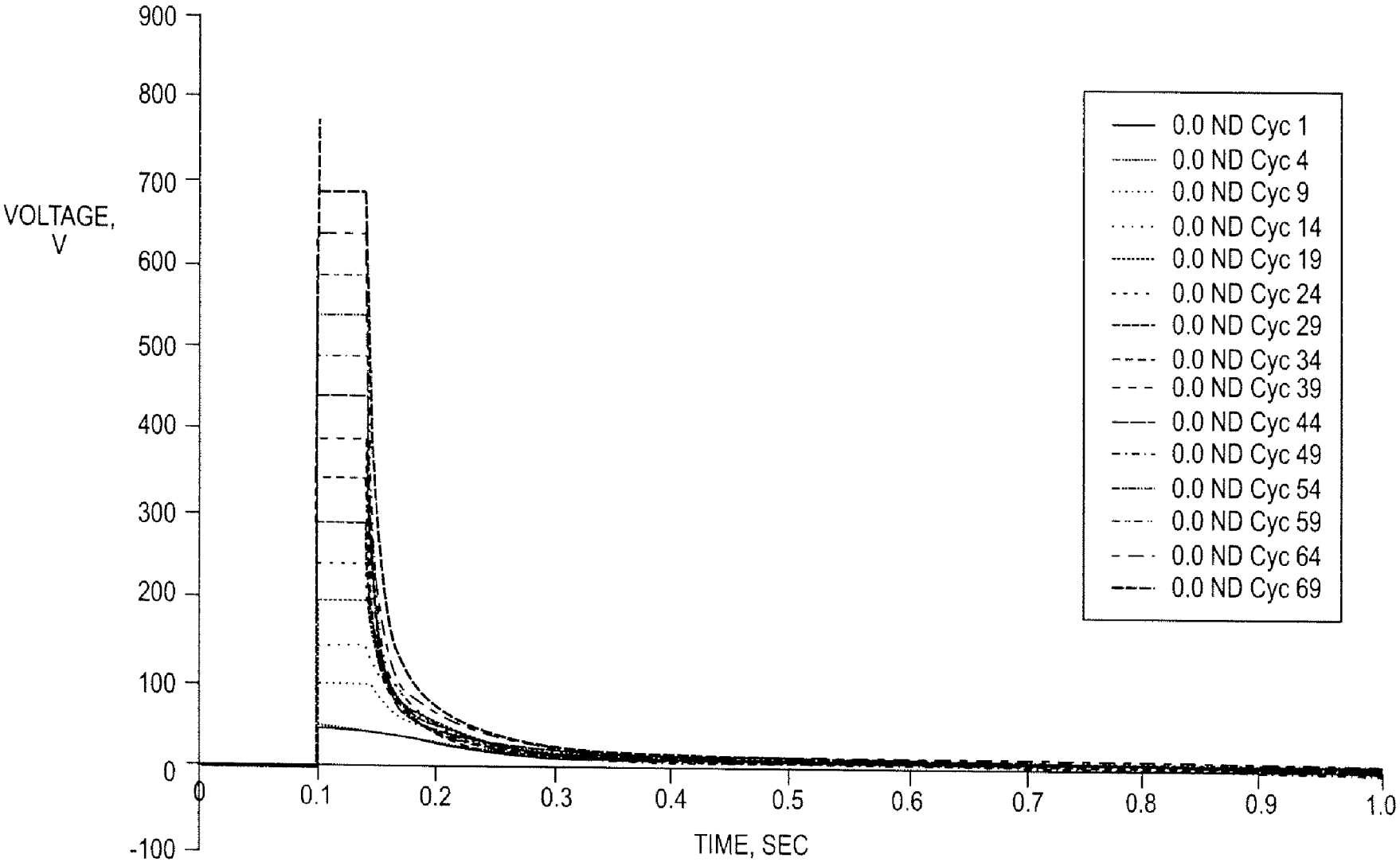
FIG. 4 is a graph illustrating the charge/discharge data of an electrostatic latent image generating member according to the present embodiments.

As seen in FIGS. 3A-3D, when the electrostatic latent image generating member is charged, hole injection from the organic conjugated polymer to the charge transport layer occurs. In particular embodiments, the charge step (FIG. 3B) takes place in the dark. Due to the hole injection (FIG. 3C), a discharge step occurs and results in the imaging member being totally or almost totally discharged (FIG. 3D). FIG. 4 is a graph showing the charge/discharge data of an imaging member made in accordance with the present embodiments. As can be seen, the discharge occurs rapidly and results in total or almost total discharge of the imaging member. In embodiments, the total discharge occurs within from about 0.1 seconds to about 5 seconds.

According to various embodiments, there is a method of forming an image including forming an electrostatic latent image in accordance with present teachings and providing a development subsystem for converting the latent image to a toner image over the charge transport layer of the electrostatic latent image generating member. The method can also include providing a transfer subsystem for transferring the toner image onto a media and feeding the media through a fuser subsystem to fix the toner image onto the media.

Figure 5:
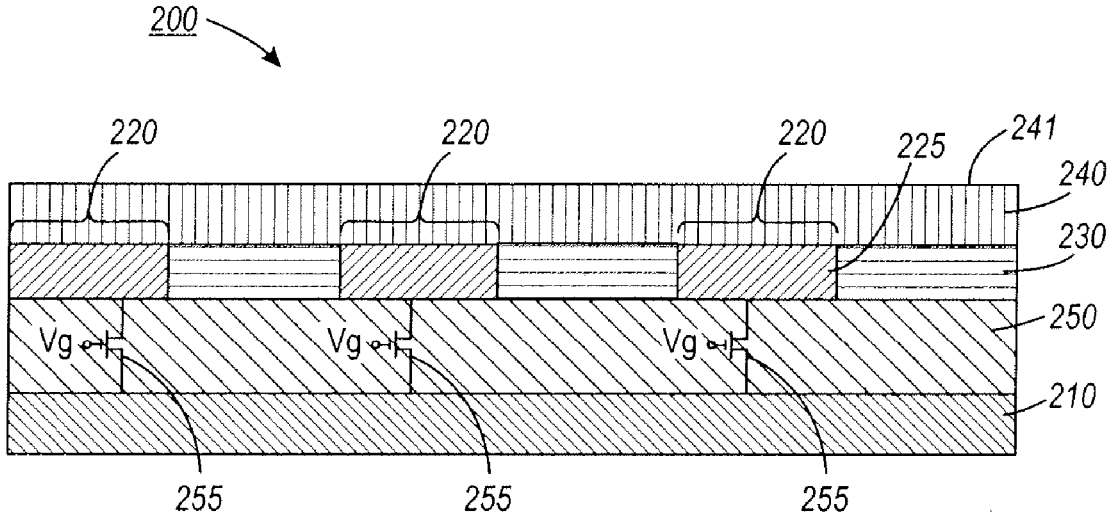
FIG. 5 is a cross-section of an electrostatic latent image generating member according to an alternative embodiment.

FIG. 5 illustrates a cross-sectional view of a portion of another exemplary electrostatic latent image generator 200, according to various embodiments of the present embodiments. The exemplary electrostatic latent image generator 200 can include a substrate 210 and an array of pixels 220 disposed over the substrate 210, such that each pixel 225 of the array of pixels 220 is electrically isolated and is individually addressable. The array of pixels 220 is electrically isolated by an insulated area 230. The exemplary electrostatic latent image generator 200 can also include an array of thin film transistors 250 disposed over the substrate 210, such that each thin film transistor 255 can be coupled to one pixel 225 of the array of pixels 220. The exemplary electrostatic latent image generator 200 can further include a charge transport layer 240 disposed over the array of pixels 220, wherein the charge transport layer 240 can include a surface 241 disposed opposite to the array of pixels 220. The charge transport layer 240 can be configured to transport holes provided by the one or more pixels 125 to the surface 241.

Figure 6:
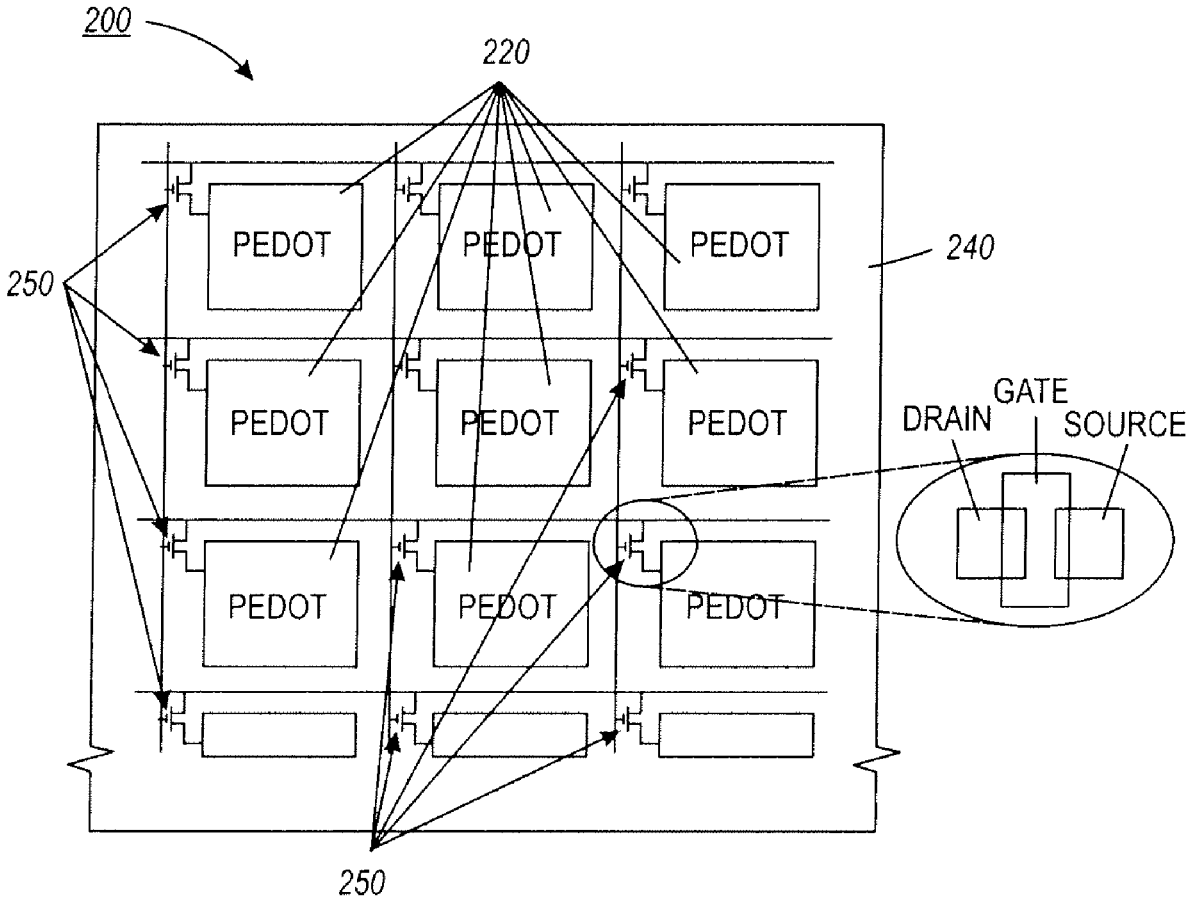
FIG. 6 is a top view of a portion of the exemplary electrostatic latent image generating member shown in FIG. 5 according to the present embodiments.

FIG. 6 schematically illustrates a top view of a portion of the exemplary electrostatic latent image generator 200 shown in FIG. 5, in accordance with various embodiments of the present disclosure.

As shown in FIG. 4, the methods described herein are very efficient. Low power, efficient digital xerography is provided when this charge injection process is patterned and coupled with a thin film transistor backplane. The present embodiments provide low cost, smaller and smart print engines. It is contemplated that the present embodiments may be further extended from digital xerography to digital liquid marking, novel printing and digital offset printing.

In the above embodiments, referring to FIGS. 3A-3D, the electrostatic latent image generator can include an array of thin film transistors disposed over the substrate 410, such that each thin film transistor can be connected to one pixel 425A, 425B of the array of pixels 420. In various embodiments, step of forming an electrostatic latent image 470 on the surface 441 of the charge transport layer 440 by individually addressing one or more pixels 425A, 425B can include setting the electrical bias of each thin film transistor of the array of thin film transistors to enable hole injection or no hole injection each pixel 425A, 425B of the array of pixels 420 to form the electrostatic latent image 470 pixel 425A, 425B by pixel 425A, 425B. The digital electrostatic latent image can be produced by switching the electric bias on and off or controlling the electrical bias to positive or negative or neutral via the thin film transistors coupled to the pixels.

In various embodiments, the array of pixels can be formed by creating a pattern or an array of pixels using a suitable nanofabrication technique, such as for example, photolithography, etching, nano-imprinting, and inkjet. Since PEDOT films are known to be patternable from nano- to micron-scales by a variety of fabrication techniques, each pixel of the array of pixels can have at least one of length and width from about 100 nm to about 150 μm, and in some embodiments from about 1 μm to about 100 μm. As discussed above, any suitable material can be used for the substrate including, but not limited to, MYLAR, polyimide (PI), poly(ethylenenapthalate) (PEN), flexible glass, and the like.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An electrostatic image generating member, comprising:
a substrate;
a hole injection layer disposed on the substrate, the hole injection layer further comprising
an addressable active matrix backplane, and
a polymer film disposed on the addressable active matrix backplane and patterned into an array of pixels disposed over the substrate; and
a charge transport layer disposed on the hole injection layer, wherein the polymer film comprises organic conjugated polymer patterned on the addressable active matrix backplane, wherein the hold injection layer injects holes from addressed pixels of the array of pixels into the charge transport layer.

2. The electrostatic latent image generating member of claim 1, wherein the charge transport layer is disposed over the array of pixels such that the charge transport layer comprises a surface disposed opposite the array of pixels and the charge transport layer is configured to transport holes provided by each pixel to the surface.

3. The electrostatic latent image generating member of claim 2, wherein each pixel of the array of pixels has at least one of length and width less than approximately 100 μm.

4. The electrostatic image generating member of claim 2, wherein the addressable active matrix backplane comprises one or more thin film transistors coupled to the array of pixels.

5. The electrostatic image generating member of claim 4, wherein a digital electrostatic image is generated by switching an electric bias to positive or negative or neutral voltage via the thin film transistors connected to the array of pixels.

6. The electrostatic image generating member of claim 1, wherein the charge transport layer comprises a charge transporting small molecule dispersed in an electrically inert polymer.

7. The electrostatic image generating member of claim 6, wherein the charge transporting small molecule is selected from the group consisting of N,N'-diphenyl-N,N'-bis(alkylphenyl)-1,1'-biphenyl-4,4'-diamine, wherein alkyl is selected from the group consisting of methyl, ethyl, propyl, butyl, hexyl, and mixtures thereof; N,N'-diphenyl-N,N'-bis(halophenyl)-1,1'-biphenyl-4,4'-diamine, wherein the halo substituent is a chloro substituent; N,N'-bis(4-butylphenyl)-N,N'-di-p-tolyl-[p-terphenyl]-4,4"-diamine; N,N'-bis(4-butylphenyl)-N,N'-di-m-tolyl-[p-terphenyl]-4,4"-diamine; N,N'-bis(4-butylphenyl)-N,N'-di-o-tolyl-[p-terphenyl]-4,4"-diamine; N,N'-bis(4-butylphenyl)-N,N'-bis-(4-isopropylphenyl)-[p-terphenyl]-4,4"-diamine; N,N'-bis(4-butylphenyl)- N,N'-bis-(2-ethyl-6-methylphenyl)-[p-terphenyl]-4,4"-diamine; N,N'-bis(4-butylphenyl)-N,N'-bis-(2,5-dimethylphenyl)-[p-terphenyl]-4,4'-diamine; N,N'-diphenyl-N,N'-bis(3-chlorophenyl)-[p-terphenyl]-4,4"-diamine, and mixtures thereof.

8. The electrostatic image generating member of claim 6, wherein the charge transporting small molecule is present in the charge transport layer in an amount of from about 10% to about 60%.

9. An electrostatic image generating member, comprising:
a substrate;
a hole injection layer disposed on the substrate, the hole injection layer further comprising
an addressable active matrix backplane, and
a polymer film disposed on the addressable active matrix backplane; and
a charge transport layer disposed on the hole injection layer, wherein the polymer film comprises organic conjugated polymer patterned on the addressable active matrix backplane, wherein the polymer film is selected from the group consisting of poly(3,4-ethylenedioxythiophene), alkyl substituted EDOT, phenyl substituted 3,4-ethylenedioxythiophene, dimethyl substituted polypropylenedioxythiophene, cyanobiphenyl substituted 3,4-ethylenedioxythiopene, teradecyl substituted poly(3,4-ethylenedioxythiophene), dibenzyl substituted poly(3,4-ethylenedioxythiophene), sulfonate substituted poly(3,4-ethylenedioxythiophene), dendron substituted poly(3,4-ethylenedioxythiophene), poly(3,4-ethylenedioxythiophene):polystyrene sulfonic acid, and mixtures thereof.

10. An electrostatic image generating member, comprising:
a substrate;

a hole injection layer disposed on the substrate, the hole injection layer further comprising
an addressable active matrix backplane, and
a polymer film disposed on the addressable active matrix backplane; and a charge transport layer disposed on the hole injection layer, wherein the polymer film comprises organic conjugated polymer patterned on the addressable active matrix backplane, wherein the substrate comprises biaxially oriented polyethylene terephthalate, polyethylene naphthalate, polyimide, and mixtures thereof.

11. An electrostatic image generating member, comprising:

a substrate;

a hole injection layer disposed on the substrate, the hole injection layer further comprising
an addressable active matrix backplane, and
a polymer film disposed on the addressable active matrix backplane; and a charge transport layer disposed on the hole injection layer, wherein the polymer film comprises organic conjugated polymer patterned on the addressable active matrix backplane, wherein the charge transport layer comprises a charge transporting small molecule dispersed in an electrically inert polymer and the electrically inert polymer is selected from the group consisting of polycarbonate resin, polyester, polyarylate, polysulfone, and mixtures thereof.

12. An electrostatic image generating member, comprising:

a substrate;

a hole injection layer disposed on the substrate, the hole injection layer further comprising
an addressable active matrix backplane, and
a polymer film disposed on the addressable active matrix backplane; and a charge transport layer disposed on the hole injection layer, wherein the polymer film comprises organic conjugated polymer patterned on the addressable active matrix backplane, and wherein the polymer film has a surface resistivity range of from about 100 ohm/sq. to about 5,000 ohm/sq.

13. An electrostatic image generating member, comprising:

a substrate;

an adhesive layer disposed on the substrate;

a hole injection layer disposed on the adhesive layer, the hole injection layer further comprising
an addressable active matrix backplane, and
a polymer film disposed on the addressable active matrix backplane and patterned into an array of pixels disposed over the substrate;
a hole blocking layer disposed on the hole injection layer; and a charge transport layer disposed on the hole injection layer, wherein the polymer film comprises poly(3,4-ethylenedioxythiophene) patterned on the addressable active matrix backplane, and wherein the hole injection layer injects holes from addressed pixels of the array of pixels into the charge transport layer.

14. The electrostatic latent image generating member of claim 13, wherein the charge transport layer is disposed over the array of pixels such that the charge transport layer comprises a surface disposed opposite the array of pixels and the charge transport layer is configured to transport holes provided by each pixel to the surface.

15. The electrostatic image generating member of claim 14 further comprising an array of thin film transistors disposed over the substrate, such that each thin film transistor is connected to one pixel of the array of pixels.

16. The electrostatic image generating member of claim 15, wherein a digital electrostatic image is generated by switching an electric bias to positive or negative or neutral voltage via the thin film transistors connected to the array of pixels.

17. The electrostatic image generating member of claim 13, wherein the charge transport layer has a thickness of from about 10 microns to about 40 microns.

18. An image forming apparatus for forming images on a recording medium comprising:

a) an imaging member having a charge retentive-surface for receiving an electrostatic latent image thereon, wherein the imaging member comprises
a substrate;
a hole injection layer disposed on the substrate, the hole injection layer further comprising
an addressable active matrix backplane, and
a polymer film disposed on the addressable active matrix backplane and patterned into an array of pixels disposed over the substrate; and
a charge transport layer disposed on the hole injection layer, wherein the hole injection layer injects holes from addressed pixels of the array of pixels into the charge transport layer;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

19. The image-forming apparatus of claim 18, wherein the charge transport layer is disposed over the array of pixels such that the charge transport layer comprises a surface disposed opposite the array of pixels and the charge transport layer is configured to transport holes provided by each pixel to the surface.

20. The image-forming apparatus of claim 19 further comprising an array of thin film transistors disposed over the substrate, such that each thin film transistor is connected to one pixel of the array of pixels.

21. The image-forming apparatus of claim 20, wherein a digital electrostatic image is generated by switching an electric bias to positive or negative or neutral voltage via the thin film transistors connected to the array of pixels.

* * * * *